US005562365A

United States Patent [19]

Berrangé

[11] Patent Number: 5,562,365

[45] Date of Patent: Oct. 8, 1996

[54] IMPACT ROLLER INCORPORATING SOIL LEVELER

[75] Inventor: Aubrey R. Berrangé, Middlesex, United Kingdom

[73] Assignee: Compaction Technology (Soil) Limited, Pinner, United Kingdom

[21] Appl. No.: 373,187

[22] PCT Filed: May 17, 1994

[86] PCT No.: PCT/GB94/01049

§ 371 Date: Apr. 17, 1995

§ 102(e) Date: Apr. 17, 1995

[87] PCT Pub. No.: WO94/26985

PCT Pub. Date: Nov. 24, 1994

[30] Foreign Application Priority Data

May 17, 1993 [GB] United Kingdom ..... 9310145

[51] Int. Cl.[6] ..... E02D 3/02; E01C 23/12; E02F 3/76

[52] U.S. Cl. ..... 405/271; 172/777; 404/90; 405/303

[58] Field of Search ..... 172/199, 777, 172/799.5, 445.1, 307; 404/90; 405/271, 303

[56] References Cited

U.S. PATENT DOCUMENTS

| | | | |
|---|---|---|---|
| 1,457,878 | 6/1923 | Hopfield | 172/777 X |
| 2,154,720 | 4/1939 | Biles . | |
| 2,909,106 | 10/1959 | Berrange . | |
| 3,066,582 | 12/1962 | Cutler . | |
| 3,130,653 | 4/1964 | Talbott . | |
| 4,348,134 | 9/1982 | Goehler . | |

FOREIGN PATENT DOCUMENTS

| | | |
|---|---|---|
| 0017511 | 9/1980 | European Pat. Off. . |
| 0156034 | 12/1984 | European Pat. Off. . |
| 1400121 | of 0000 | Switzerland . |
| 436371 | 11/1967 | Switzerland . |

*Primary Examiner*—Tamara L. Graysay
*Assistant Examiner*—Tara L. Mayo
*Attorney, Agent, or Firm*—Limbach & Limbach

[57] ABSTRACT

Compaction of a soil surface is achieved by means of a machine (10) which has a movable, wheeled carriage (20) and an impact roller coupled resiliently to the carriage so as to move together with the carriage. The impact roller has one or more out-of-round compactor masses (12) designed to apply periodic impact blows to the soil surface (36). A soil working implement, in the form of an upright scraper blade (44) is carried by the carriage in a position trailing the impact roller. The function of the blade is to scrape soil into the localized indentations (40) that are formed in the soil surface by the periodic impact blows applied by the compactor mass or masses. This smooths out the soil surface for subsequent passes and reduces the shock loading on the tractive vehicle which pulls the carriage.

17 Claims, 1 Drawing Sheet

IMPACT ROLLER INCORPORATING SOIL LEVELER

This application is a United States National Phase filing of International Application Number PCT/GB94/01049 with an International filing date of May 17, 1994.

BACKGROUND TO THE INVENTION

THIS invention relates to the compaction of soil and in particular to the compaction of soil using an impact roller.

The term "impact roller", as used initially in U.S. Pat. No. 2,909,106, refers to a compactor mass of non-round shape which, when towed over a soil surface, produces a series of periodic impact blows on the soil surface. The compactor mass of an impact roller has a series of spaced apart, salient points on its periphery. Each such salient point is followed by a re-entrant portion of the periphery and each re-entrant portion is followed in turn by a compacting face. As the impact roller is towed over the soil surface, for instance by means of a tractor, it rises up on each salient point and then falls forwardly and downwardly as it passes over that point, with the result that the following compacting face applies an impact blow to the soil surface.

The coupling between the tractor and the compactor mass is resilient in nature to allow for the necessary forward and downward falling motion undergone by the mass as it passes over each salient point.

In practice, as the compactor mass is towed over the soil surface, it produces a series of indentations in the soil surface, spaced apart in the direction of movement of the mass.

The longitudinal spacing of the indentations is the same as the peripheral spacing of the compacting faces of the compactor mass. For example a mass having three salient points and compacting faces and a total peripheral dimension of 6 m, which would be typical in current soil compaction practice, will produce a soil indentation approximately every 2 m. At a typical operating speed of 10 km/h impact blows are applied to the soil surface at a frequency of about 1,4 Hz.

The resulting cyclical shock reaction forces on the tractor can cause severe vertical bounce, pitching and rolling of the tractor and compactor mass and consequent damage to mechanical components and discomfort for the tractor operator. The depth of the soil indentations and hence the severity of the tractor bounce phenomenon is dependent upon factors such as soil density and moisture content, and energy per impact blow delivered by the compactor mass.

With a view to countering the bounce phenomenon, common practice is to make a first pass over the soil at an efficient operating speed of, say 10 km/h, and then reduce speed during subsequent passes as the indentations in the soil surface become more severe. A reduction in speed results however in a reduction in productivity and efficiency.

It is also common practice to use a motor grader to smooth the surface of the soil continuously during the compaction process. Some of the soil cut and moved by the grader blade falls into the indentations for compaction during subsequent passes of the compactor mass. In addition, water is generally sprayed into the soil surface at intervals during the compaction process in order to improve the compactibility of the soil. This watering of the soil performs a second important function in preventing the formation of a layer of surface dust which has the effect of attenuating the compaction blow.

While watering and grading can to some extent alleviate the problems of tractor bounce, the fact remains that most of the soil that is relocated by the grading operation is not used for smoothing out the indentations, due to the excessive width of the grader blade in relation to the track of the usual compactor mass. Furthermore, existing practice is to water a wide zone of soil surface with a spray bar, generally in excess of three metres wide. Thereafter the uneven surface is bladed with a grader. Most of the water used in thus preparing a large area for compaction is lost through evaporation into the atmosphere before compaction of the soil is achieved.

SUMMARY OF THE INVENTION

According to the invention there is provided a soil compaction machine which comprises:

a movable, wheeled carriage, an impact roller which is coupled resiliently to the carriage for movement with the carriage and which comprises an out-of-round compactor mass adapted to apply periodic impact blows to a soil surface over which it is moved by the carriage, and a soil working implement which is carried by the carriage in a position trailing the impact roller so as to direct soil from the soil surface into localised indentations that are formed in the soil surface by the periodic impact blows applied by the compactor mass.

The soil working implement is preferably an operatively upright soil working blade arranged to scrape soil into the indentations formed in the soil surface by the blows applied thereto.

In the preferred embodiment, the machine comprises two side-by-side impact rollers, a common shaft on which the impact rollers are mounted for rotation substantially in unison and separate soil working blades carried by the carriage in positions trailing the respective compactor masses. The machine may furthermore include lifting and lowering means for lifting and lowering the blades with respect to the soil surface. There may be a common mechanism for this purpose, or separate mechanisms for independently lifting and lowering the blades. In the former case, the lifting and lowering means preferably comprises links to which the blades are pivotally connected, a shaft to which the links are solidly connected and one or more hydraulic cylinders acting between the carriage and the shaft, extension or retraction of the cylinder or cylinders causing the shaft and links to rotate and the blades to move up or down.

Conveniently each link has a plurality of connection points at which the respect blades are pivotally connected to the links.

There may also be blade orientation adjustment means operable to adjust the orientation of the blades with respect to the vertical. Such means may include hydraulic cylinders acting between the carriage and the blades.

In addition to the blade or blades mentioned above, there may also be one or more further, operatively upright soil working blades arranged to perform a scraping action on the soil surface in advance of the impact roller.

According to a preferred feature, the machine includes water spray means arranged to spray water onto the soil surface in positions trailing the compactor masses and in advance of the soil working blades. Preferably, the water spray means is arranged to spray water substantially only in the paths traversed by the compactor masses.

According to another aspect of the invention there is provided a method of compacting soil, the method comprising the steps of:

causing an impact roller to move operatively in a forward direction over the surface of soil which is to be compacted such that an out-of-round compactor mass of the impact roller periodically applies an impact blow to the soil surface, and during such movement, scraping soil from the soil surface behind the compactor mass and directing such soil forwardly into indentations formed in the soil surface by the periodic impact blows applied thereto by the compactor mass.

BRIEF DESCRIPTION OF THE DRAWINGS

The invention will now be described in more detail, by way of example only, with reference to the accompanying drawings in which.

DESCRIPTION OF AN EMBODIMENT

Figure 1:
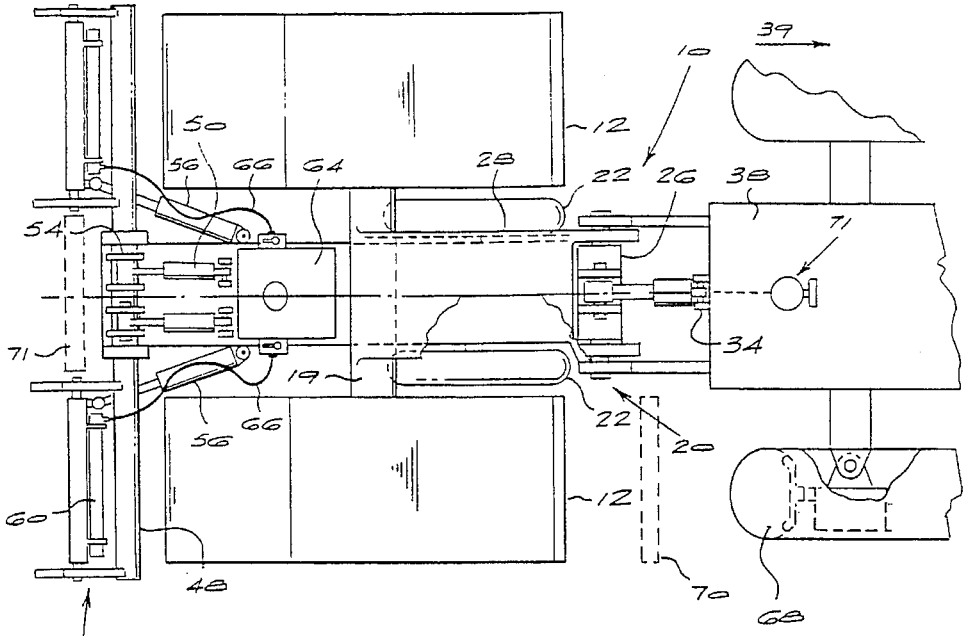
FIG. 1 shows a partially fragmentary plan view of a soil compaction machine according to the invention.

The illustrated soil compaction machine 10 employs two impact rollers or compactor masses 12 located side-by-side in spaced apart relationship. Each impact roller 12 is a three-sided roller with three peripherally spaced salient points 14. Each salient point 14 is followed, in the direction of rotation of the rollers 12, by a re-entrant portion 16, and each re-entrant portion is followed by a compacting face 18. The impact rollers 12 are mounted fast on a common axle 17 in an axle housing 19, so as to rotate substantially in unison when the compaction machine is in operation, as described below.

A carriage 20 mounted on ground-engaging wheels 22 is located between the impact rollers 12. Pinned at a pivot point 24 to the leading end of the carriage is an upright drop link 26. One end of a generally horizontal drag link 28 is connected fast to the axle housing 19. The other end of the drag link 28 is pinned to the drop link 26 at a pivot point 30. A spring 32 is pivoted between the upper end of the drop link 26 and a clevis 34 at the rear end of a tractor seen partially at 38. The spring 32 may be a mechanical or hydraulic spring or, as illustrated, an hydraulically actuated traction rod connected to a gas-filled accumulator 71 so as to provide required load-deflection characteristics.

Figure 2:
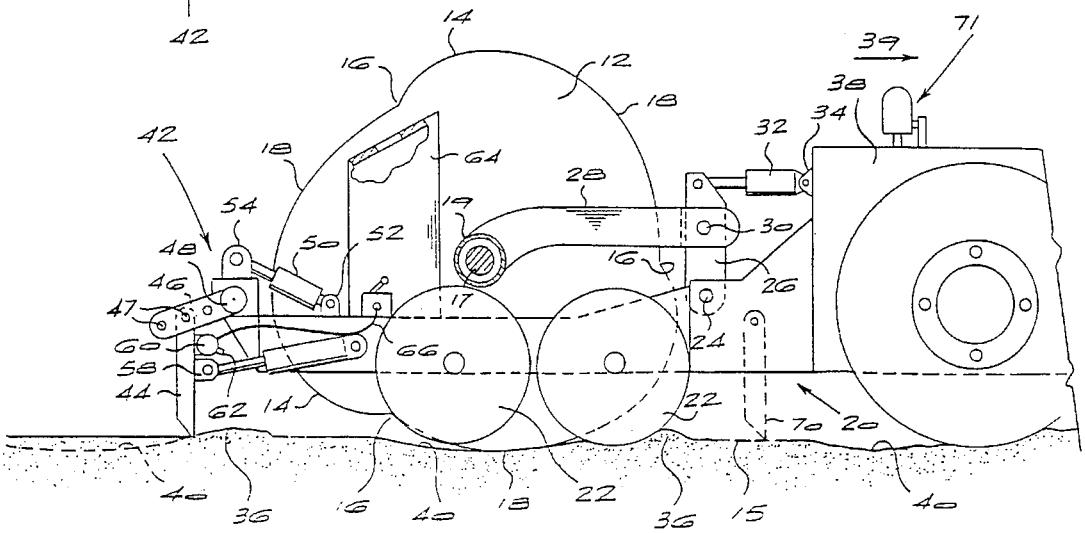
FIG. 2 shows a part sectional side elevation of the machine seen in FIG. 1 with one mass removed so as expose the carriage to view.

It will be appreciated that the linkage between the carriage 20 and the impact rollers 12 is resilient in nature. In operation the tractor 38 travels forwardly in the direction of the arrow 39 and pulls the carriage 20 and the impact rollers 12 behind it. Aside from slight asynchronism permitted by the torsional resilience of the common axle 17, the impact rollers 12 rotate in unison with one another. During such rotation of each impact roller 12 it undergoes a repetitive sequence in which the mass rises up on a salient point 14 then, once an over-centre condition is reached, drops downwardly and forwardly for the following compacting face 18 to impact against the soil surface. The impact blows applied to the soil surface by the impact roller typically result in the creation of indentations 40 such as that seen in FIG. 2.

To fill the indentations 40 produced by the impact rollers with moistened soil, and also to level the mounds of soil 36 that protrude above the average soil surface level designated with the numeral 15, the carriage is provided with a soil working system for each impact roller.

Each soil working system 42 includes a blade 44 which lies in a generally upright plane and which has a length corresponding to the tread width of the associated impact roller.

Links 46 are provided with several hole positions 47 about any chosen one of which the upper edge of the blade 44 can be pivoted. The link 46 is connected fast to a shaft 48 common to both blades 44. Double acting hydraulic rams 50 are connected pivotally between clevises 52 on the carriage and clevises 54 which are connected solidly to the shaft 48. For each blade, it will be appreciated that the arrangement of links 46, shaft 48 and clevises 54 constitutes a bell-crank mechanism operating to raise or lower the blade relative to the soil surface 15 according to whether the rams 50 are retracted or extended.

Although the shaft 48 is shown as operating both blades simultaneously, it is envisaged that in other embodiments each of the two hydraulic rams 50 can operate upon a separate, rotatable shaft so as to enable the blades to be operated independently of the other.

By extending or retracting the rams 50 it is possible to vary the depth of cut of the blades 44. The orientation of the blades 44 and the longitudinal position of their cutting tips can be set by means of double acting rams 56 extending in each case between the carriage and a bracket 58 on the associated blade. For greater variation or adjustment in the longitudinal sense, the point of pivotal connection of each blade may be moved to one of the other hole positions 47 in the link 46.

The rams 50 and 56 are controlled from an operator station (not shown) on the tractor 38 through hydraulic circuitry which is omitted from the Figures in the interests of clarity but the nature of which will be readily apparent to those skilled in the art.

It is envisaged that more complicated linkages may be provided to allow for fine variations in the cutting angle of the blades to suit different conditions. Furthermore, although not illustrated in the Figures, the blades 44 may be provided with replaceable cutting tips.

It is also within the scope of the invention for the illustrated blades to be replaced by other soil working implements such as, for instance, sharp tines. It is also possible for the soil working system to comprise two soil working assemblies. The first assembly is positioned as described above and the second mounted, as indicated diagrammatically by the numeral 70, between the impact roller and the wheel 68 of the tractor 38. In this way two separate implements may be used alternately or simultaneously.

A water spray head 60 fitted with spray nozzles 62 is mounted on each blade as illustrated. The spray head is supplied with metered amounts of water under gravity or under pressure from a water tank 64, mounted on the carriage, via hoses 66.

In operation of the soil working system, the spray heads spray water onto the soil surface 15 behind the impact rollers and ahead of the blades 44. The blades then cut through the high points 36 of the moistened soil surface and move the cut soil forwardly into the previously formed indentations 40.

The soil fills the indentations in preparation for compaction on a subsequent pass of the machine over the soil surface.

In a case where blade assemblies are provided ahead of the impact rollers, watering may also be included in the blade assemblies so that watering also takes place immediately prior to compaction.

It will be noted that the provision of a blade for each impact roller means that relatively small volumes of soil are shifted to fill the indentations 40. The action of the blades 44 on the soil therefore consumes little power and it is anticipated that the use of these blades will be more efficient in power consumption and capital cost than the use of a separate motor grader between passes of the compaction machine.

A further advantage of the machine as described above is the fact that the watering of the soil surface is localised in the areas where soil working and compaction are actually taking place. Thus there is a reduced water consumption compared to the current system where generalised soil watering takes place. The fact that the water tanks add mass to the carriage and impact roller structure is not considered to be a major drawback since it is, in any event, common practice to ballast the machine to improve its traction on the soil.

I claim:

1. A soil compaction machine which comprises:

a movable, wheeled carriage, a pair of impact rollers which are coupled to the carriage for movement with the carriage and each of which comprises an out-of-round compactor mass, the impact rollers being arranged in spaced apart, side by side relationship, the impact rollers being arranged to apply periodic impact blows to a soil surface when moved in an operative, forward direction over the soil surface with the carriage, such periodic impact blows forming alternating humps and depressions in the soil surface along spaced apart tracks traversed by the respective impact rollers, and for each impact roller, a soil working blade which is carried by the carriage in a position trailing behind the respective impact roller and which is oriented transversely to the forward direction, each blade having a transverse dimension corresponding to the width of the track traversed by the respective impact roller, the blades operating to cut soil from the humps and to distribute that soil into the depressions and thereby perform a soil levelling action in the tracks traversed by the impact rollers.

2. A soil compaction machine according to claim 1 and comprising lifting and lowering means for lifting and lowering the soil working blades with respect to the soil surface.

3. A soil compaction machine according to claim 2 wherein the lifting and lowering means comprises links to which the blades are pivotally connected, a shaft to which the links are connected and one or more hydraulic cylinders acting between the carriage and the shaft, extension or retraction of the cylinder or cylinders causing the shaft and links to rotate and the blades to move up or down.

4. A soil compaction device according to claim 3 wherein each link has a plurality of connection points at a selected one of which the respective blade is pivotally connected to the link.

5. A soil compaction device according to claim 2 wherein the lifting and lowering means includes means for lifting and lowering the blades independently of one another.

6. A soil compaction machine according to claim 2 and comprising blade orientation adjustment means operable to adjust the orientation of the blades with respect to the vertical.

7. A soil compaction machine according to claim 6 wherein the blade orientation adjustment means comprises hydraulic cylinders acting between the carriage and the blades.

8. A soil compaction machine according to claim 1 and comprising one or more further, operatively upright soil working blades arranged to perform a scraping action on the soil surface in advance of the impact rollers.

9. A soil compaction machine according to claim 1 and comprising water spray means arranged to spray water onto the soil surface at positions trailing the impact rollers and in advance of the soil working blades.

10. A soil compaction machine according to claim 9 wherein the water spray means is arranged to spray water substantially only in the paths traversed by the impact rollers.

11. A soil compaction machine which comprises:

a movable, wheeled carriage, an impact roller which is coupled resiliently to the carriage for movement with the carriage and which comprises an out-of-round compactor mass, adapted to apply periodic impact blows to a soil surface over which it is moved by the carriage, a soil working blade which is carried by the carriage in a position trailing the impact roller so as to direct soil from the soil surface into localised indentations that are formed in the soil surface by the periodic impact blows applied by the compactor mass, and lifting and lowering means for lifting and lowering the blade with respect to the soil surface, wherein the lifting and lowering means comprises links to which the blade is pivotally connected, a shaft to which the links are solidly connected and one or more hydraulic cylinders acting between the carriage and the shaft, extension or retraction of the cylinder or cylinders causing the shaft and links to rotate and the blade to move up or down.

12. A soil compaction device according to claim 11 wherein each link has a plurality of connection points at a selected one of which the blade is pivotally connected to the link.

13. A soil compaction machine according to claim 11 and comprising blade orientation adjustment means operable to adjust the orientation of the blade with respect to the vertical.

14. A soil compaction machine according to claim 13 wherein the blade orientation adjustment means comprises hydraulic cylinders acting between the carriage and the blade.

15. A soil compaction machine according to claim 11 and comprising one or more further, operatively upright soil working blades arranged to perform a scraping action on the soil surface in advance of the impact roller.

16. A soil compaction machine according to claim 11 and comprising water spray means arranged to spray water onto the soil surface at positions trailing the impact roller and in advance of the soil working blade.

17. A soil compaction machine according to claim 16 wherein the water spray means is arranged to spray water substantially only in the paths traversed by the impact roller.

* * * * *